United States Patent [19]

Dzewaltowski et al.

[11] Patent Number: 4,539,778

[45] Date of Patent: Sep. 10, 1985

[54] AUTOMATIC DUAL COMPENSATION GRINDING WHEEL CONDITIONER

[75] Inventors: Victor F. Dzewaltowski, Springfield; Richard H. Gile, North Clarendon, both of Vt.

[73] Assignee: Ex-Cell-O Corporation, Troy, Mich.

[21] Appl. No.: 682,632

[22] Filed: Dec. 17, 1984

Related U.S. Application Data

[63] Continuation of Ser. No. 418,103, Sep. 14, 1982, abandoned.

[51] Int. Cl.[3] ..... B24B 49/18; B24B 53/06

[52] U.S. Cl. ..... 51/165.87; 125/11 R

[58] Field of Search ..... 51/5 D, 165.87, 165.88; 125/11 R

[56] References Cited

U.S. PATENT DOCUMENTS

| | | | |
|---|---|---|---|
| 3,971,168 | 7/1976 | Nishimura et al. | 51/165.87 X |
| 4,020,820 | 5/1977 | Kish | 125/11 R |
| 4,122,635 | 10/1978 | Asano et al. | 51/165.87 X |
| 4,266,374 | 5/1981 | Asano et al. | 51/165.87 |

*Primary Examiner*—James G. Smith

*Attorney, Agent, or Firm*—John C. Evans

[57] ABSTRACT

An improved method to surface condition a super-abrasive grinding wheel by intermittently moving the wheel to a stationary wheel conditioner unit mounted adjacent the grinding wheel with the conditioner unit having a consumable element engaged by the grinding wheel to condition the grinding wheel including a dual compensation method having the steps of grinding a predetermined number of workpieces to establish a first predetermined depth of super-abrasive wheel wear; periodically conditoning the wheel surface by consuming a second predetermined depth from a consumable reconditioning tool surface; and producing a first compensation of a grinding wheel by controlling the position of the super-abrasive wheel with respect to the workpiece to maintain an apparent wheel wear depth within the range of desired workpiece tolerance and producing a second compensation of a grinding wheel conditioner by contacting the wear surface of the super-abrasive wheel with the reconditioning tool surface and advancing it into and away from the tool surface a distance equal to the second predetermined depth each time that the wheel is reconditioned so as to assure that individual grains of the super-abrasive constituent of the wheel will extend beyond the bonding material constituent of the wheel to maintain cutting efficiency of the wheel following the reconditioning step.

3 Claims, 1 Drawing Figure

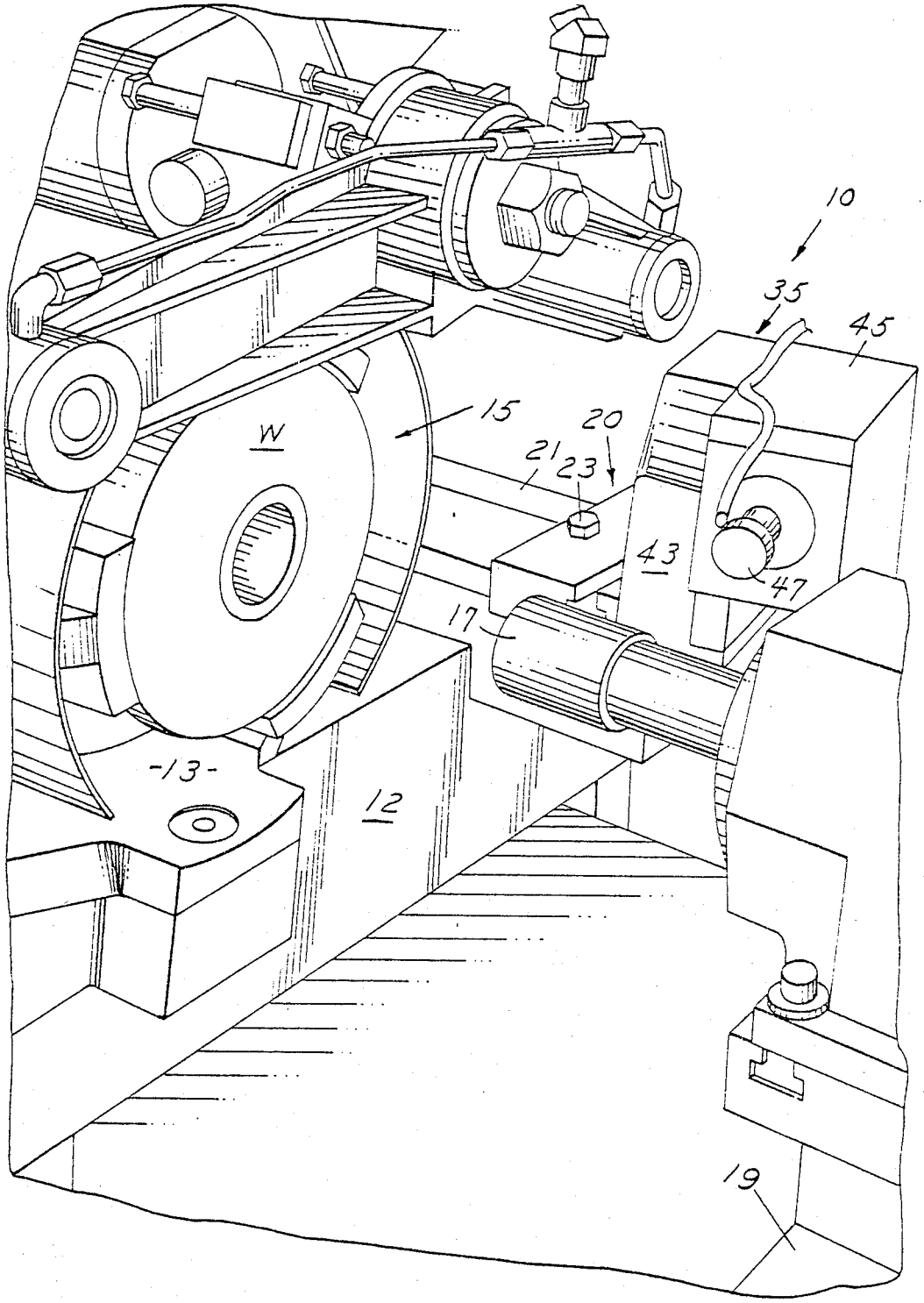
10
35
45
15
20
21
23
W
43
47
17
-13-
12
19

AUTOMATIC DUAL COMPENSATION GRINDING WHEEL CONDITIONER

This application is a continuation of application Ser. No. 418,103, filed 9-14-82 now abandoned.

TECHNICAL FIELD

This invention relates generally to the grinding machine art and, more specifically, to an improved method to surface condition a cubic boron nitride grinding wheel by intermittently moving the wheel to a stationary wheel conditioner unit mounted adjacent the grinding wheel with the conditioner unit having a consumable element engaged by the grinding wheel to condition the grinding wheel.

BACKGROUND ART

It is well known in the grinding machine art to dress the outside periphery of a consumable abrasive grinding wheel by several methods or forms; such as, a single point diamond, a multipoint diamond, rotary diamond, or diamond roll. The type of work being performed prescribes the dressing method which will provide optimum performance. Most automatic grinding machinery is based on the use of a relatively consumable grinding wheel, such as aluminum oxide or silicon carbide, which is periodically conditioned (trued or dressed) by a relatively non-consumable tool, such as a single-point diamond or a fixed cluster of multiple diamond points or a rotating diamond wheel (called a roll or a cutter). Since the relatively consumable wheel generally loses the ability to grind properly before it loses a significant amount of dimensional accuracy, it is generally reconditioned (dressed) before the dimensional accuracy of the workpieces is affected. Since the distance between the surface of a finished workpiece and the cutting surface of the wheel conditioning tool remains fixed, all that is required of the automatic machine is the periodic decrease of the distance between the wheel and the dresser/workpiece combination. This decrement is called "compensation" or "dress compensation". Depending on the construction of the machine, either the wheel is compensated, or the work support carries the dresser and the work support is compensated. In either case, the compensation usually takes place just prior to the wheel being passed by the dressing tool, and the dressing tool removes this amount from the wheel, leaving the relative positions of the critical surfaces of the wheel and the workpiece and the dresser essentially just as they were before compensation took place.

Modern super-abrasives, such as diamond and cubic boron nitride, are more difficult to incorporate into a fully automatic process. The problem is caused by the very property of these abrasives which makes them so attractive: their extreme resistance to wear. Wheels made of these materials wear extremely slowly and in most cases very evenly. In some applications using cubic boron nitride, the need for reconditioning of the wheel surface is demonstrated by an increase in the roughness of the finished workpiece surface. In those cases the proper remedy is to compensate a small amount, say 0.0001", and then pass the wheel by a rotating diamond cutter. This still constitutes the use of a somewhat consumable wheel and a relatively non-consumable wheel conditioning tool as described above. Initial truing of a cubic boron nitride wheel to remove eccentricity after mounting also falls in this category.

However, in many applications the need for reconditioning of the wheel surface is demonstrated by a reduction in the ease with which the wheel cuts, an increase in force and temperature. The cause of these effects is the loss of "stick-out" of the individual diamond or cubic boron nitride abrasive grains beyond the material which bonds them together. The remedy is to wear or erode some of the bond material away without significantly wearing or pulling out the diamond or cubic boron nitride particles. This is accomplished by having the wheel do some grinding on some relatively soft aluminum oxide or silicon carbide, either in the form of a stationary stick or a rotating wheel. The latter is either motorized or equipped with a braking device which limits the rotational speed which the soft wheel can achieve as a result of the driving action of the super-abrasive wheel.

DISCLOSURE OF THE INVENTION

The invention relates to a consumable dresser method for conditioning the grinding surface of a super-abrasive grinding wheel. Since a soft conditioning stick or wheel wears significantly, an automatic method of the present invention takes into account and keeps track of the amount of such wear. Since the super-abrasive particles also wear, though as a result of grinding a large number of workpieces and not as a result of the reconditioning process, the method of the present invention also takes this into account.

In particular, an object of the present invention is to improve wear and conditioning of the wear surface of a super-abrasive wheel having a super-abrasive constituent and a bonding material constituent engageable with a consumable reconditioning tool by the provision of a method including selecting a predetermined depth of wheel wear at which reconditioning is to occur; during each workpiece grinding step adjusting the position of the wheel in addition to normal feed movements between the wheel and the workpiece to compensate for incremental wear of the wheel to maintain apparent wheel wear within the tolerance range of the workpiece being ground until the predetermined depth of wheel wear occurs; and thereafter positioning the wheel with respect to the consumable reconditioning tool to cause the tool to be consumed by the wheel to a depth an order of magnitude greater than the predetermined depth of wheel wear so as to assure that individual grains of the super-abrasive constituent of the wheel will extend beyond the bonding material constituent of the wheel to maintain cutting efficiency of the wheel following the reconditioning step.

Another object of the present invention is to provide a dual compensation method for conditioning a super-abrasive grinding wheel including the steps of grinding a predetermined number of workpieces to establish a first predetermined depth of super-abrasive wheel wear; periodically conditioning the wheel surface by consuming a second predetermined depth from a consumable reconditioning tool surface; and producing a first compensation of a grinding wheel by controlling the position of the super-abrasive wheel with respect to the workpiece to maintain an apparent wheel wear depth within the range of desired workpiece tolerance and producing a second compensation of a grinding wheel conditioner by contacting the wear surface of the super-abrasive wheel with the reconditioning tool surface and advancing it into and away from the tool surface a distance equal to the second predetermined depth each time that the wheel is reconditioned.

Still another object of the present invention is to provide an improved dual compensation method for conditioning the wear surface of a super-abrasive grinding wheel comprising the steps of locating a workpiece support and a reconditioner tool support at fixed locations and locating a super-abrasive grinding wheel on a movable platform; driving the platform by drive means under the control of a programmable controller; programming the controller to move the wheel into engagement with a consumable reconditioning tool surface on the tool support only following a predetermined number of grinding sequences wherein the wheel grinds a predetermined number of workpieces on the fixed workpiece support so as to produce a corresponding first predetermined depth of wear of the grinding surface on the wheel; programming the controller to produce a first compensation of the super-abrasive wheel by advancing the wheel with respect to the predetermined number of workpieces in addition to normal grinding wheel feed movement and in accordance with a predetermined schedule to maintain the apparent wear of the wear surface of the grinding wheel within desired workpiece tolerance ranges; and further programming the controller to produce a second compensation of the super-abrasive wheels during each reconditioning step by advancing and retracting the wheel into the surface of the consumable reconditioning tool a predetermined depth an order of magnitude greater than the first predetermined depth of wear.

BRIEF DESCRIPTION OF THE DRAWING

The drawing shows a perspective view disclosing a grinding wheel, the workpiece support and consumable reconditioning tool suitable for practicing the method of the present invention.

BEST MODE OF CARRYING OUT THE INVENTION

Referring now to the drawing, the numeral 10 generally designates a one-station electro-mechanical internal grinding machine with one grinding wheel spindle on a cross slide driven by CNC controlled drive motors embodying the principles disclosed in co-pending application Ser. No. 152,286 filed May 22, 1980. As stated in the aforesaid '286 application, any suitable programmable controller may be employed, such as a Bryant Series 75 programmable controller available from the Westinghouse Electric Corporation of Gateway Center, Pittsburgh, Pa. 15222. A suitable feed control is one available on the market from Intel Corporation of Santa Clara, Calif. 95054, and which is sold under the name of "INTEL" (a trademark), 80/05 Single Board Computer. The drive means may be any suitable servo drive means as, for example, a servo drive of Hyper Loop, Inc., of 7459 W. 79 Street, Bridgeview, Ill. 60455, under the trademark ∓HYAMP". The "HYAMP" servo drive is a single-phase, four wave, bi-directional SCR controlled servo drive for D.C. motors, and it provides D.C. drive power for precise speed control and regulation over a wide speed range. Another suitable servo-drive, designated as Size 50, is available from General Electric Company, 685 West Rio Road, Charlottsville, Va. 22906.

The drive motor for each axis is a D.C. servo motor. Suitable D.C. servo motors of this type are available from Torque Systems Incorporated, 225 Crescent Street, Waltham, Mass. 02154, under the trademark "SNAPPER", and identified as frame sizes 3435 and 5115. A large motor of this type is also available from the H. K. Porter Co., of 301 Porter Street, Pittsburgh, Pa. 15219.

Tachometers are part of the D.C. servo motors. Resolvers, encoders or "INDUCTOSYN" transducers are used in the feedback system and they may be any suitable conventional position feedback devices available on the market. Resolvers of this type are available from the Clifton Precision Company of Clifton Heights, Pa. 19018. "INDUCTOSYN" precision linear and rotary position transducers are available from Farrand Controls, a division of Farrand Industries, Inc., of 99 Wall Street, Valhalla, N.Y. 10595. A suitable optical shaft angle encoder, designated by Model No. DRC-35 is available from Dynamics Research Corporation of 60 Concord Street, Wilmington, Md. 01887.

The grinding machine 10 includes a conventional bed or bridge member 12 on which is operatively mounted a conventional fixed workhead 13. The workhead 13 may be of any suitable conventional structure and it comprises a chucking fixture 15 for holding a workpiece. The chucking fixture is adapted to be rotated by a motor and an operatively connected pulley means disclosed in the above-mentioned co-pending application.

As shown in the drawing, a bore grinding wheel 17 is operatively carried on the compound slide assembly 19, on the right end of the machine 10, which comprises the longitudinal and cross slides disclosed in the above-noted co-pending application. It will be understood that the control system of the present invention is capable of controlling any combination of motions of a grinding wheel on the compound slide assembly. The grinding wheel 17 is a super-abrasive wheel having particles of diamond or cubic boron nitride defining a super-abrasive constituent of the wheel and a suitable bonding constituent holds the particles so that end segments on each particle stick out from the bonding material to define the workpiece cutting surface on the wheel.

A consumable grinding wheel conditioner unit 20 is mounted on the workhead bridge 12 on a base extension member 21 which extends or cantilevers over the center of the machine grinding area. The unit 20 has a base 31 secured by means of bolts 23 slidable in T-slots 25 of the base extension member 21. A slide base unit 35 is adjustably fixed for transverse movement on base 31. The unit 35 has a transverse portion 43 extending upwardly to form a side support wall for the dressing unit 45. A consumable reconditioning tool 47 is on unit 45.

In operation, the grinding wheel 17 is rotated to grind the bore or face of workpiece or any combination thereof. The longitudinal slide provides the grinding wheel 17 with a sequence of movements such as rapid forward traverse, slow infeed, high speed reciprocation and back-off retraction. The cross slide provides the grinding wheel 17 with positioning movements and compensation movements to compensate for the wearing away of the grinding wheel in the grinding of each part. The control system of the present invention is disclosed in co-pending aforementioned patent application and need not be discussed in detail herein.

During conditioning, the grinding wheel 17 is carried on the compound slide over to the conditioning unit 20 where it is conditioned or dressed by a soft conditioning element or reconditioning tool 47 made of materials such as aluminum oxide or silicon carbide. Such materials are characterized as being softer than the super-abrasive particles of wheel 17 and of a hardness to abrade away the bonding constituent of wheel 17.

Following extended grinding sequences made possible by the improved wearability of the super-abrasive particles of wheel 17 a condition can occur where the exposed ends of the particles no longer "stick out" or extend from the surface of the wheel 17. The remedy is to wear or erode some of the wheel bond material away from the wheel so as to expose super-abrasive particles without significantly wearing or pulling out the super-abrasive particles.

In accordance with the invention, a soft conditioning stick or wheel is used as a reconditioning tool in a dual compensation wheel conditioner method to maintain grinding machine efficiency. The stationary unit of the conditioner is rigidly clamped and formed with relatively stiff plate segments that define a stable accurately positioned platform for the reconditioning tool which has a reduced spring rate. The reconditioning tool 47 is positioned to provide for a more accurate and stable method of dressing the grinding wheel which not only is simple and more reliable, but enhances reconditioning of the super-abrasive wheel 17.

One example of the method assumes the following criteria. The wheel 17 is reconditioned after 100 workpieces are ground. The wheel wears 0.001 inches during that interval. The workpiece tolerance is such that wheel wear should be kept down to 0.0001 inches or less. The reconditioning tool wear is 0.025 inches each time the wheel is fully reconditioned (an order of magnitude greater than the wheel surface wear). The workpiece support and the reconditioner tool support have fixed locations and the wheel is moved by a CNC controller.

The first of the "dual" compensations is used to keep the apparent wheel wear down to 0.0001 inches or less. The CNC is therefore programmed to advance the wheel toward the work by 0.0001 inches after grinding 10 workpieces, or 0.00001 inches after every workpiece, or any suitable combination in between these two. This advance is in addition to the normal feed movements.

The second of the "dual" compensations is used to assure two things: that the wheel contacts the reconditioning tool properly and advances 0.,025" into it in the right manner each time, and that the wheel backs away from the reconditioning tool an additional 0.025" each successive time so as to be in the proper position for being brought into contact with the workpiece. The CNC controller is therefore programmed to advance the wheel toward the reconditioning tool after grinding 100 workpieces, either to the position it had when it was last advanced into it or to 0.025" beyond the position it had when it was last advanced up to it (both being the same), then to advance into the reconditioning tool 0.025" at a specified rate, then an optional time to dwell, then to retract to the proper position for being brought into contact with the workpiece.

What is claimed is:

1. A method of dual compensation for wear control and conditioning of the wear surface of a super-abrasive wheel having a super-abrasive constituent and a bonding material constituent such wheel being mounted on a drive spindle and relatively moveable to be engageable with a consumable reconditioning tool comprising: fine truing the wheel by adjusting the position of the wheel in addition to normal feed movements between the wheel and the workpiece during a select number of workpiece grinding steps to compensate for incremental wear of the wheel to maintain apparent wheel wear within the tolerance range of the workpiece being ground; terminating such fine truing at a predetermined depth of wheel wear produced by such wheel grinding steps; and thereafter relatively positioning the wheel while on its drive spindle with respect to a consumable non-metallic reconditioning tool to cause the tool to be consumed by the wheel to a depth an order of magnitude greater than the predetermined depth of wheel wear so as to remove said bonding material so that individual grains of the super-abrasive constituent of the wheel will extend beyond the bonding material constituent of the wheel to re-establish cutting efficiency of the wheel following the select number of wheel grinding steps.

2. A dual compensation method for conditioning a super-abrasive grinding wheel mounted on a drive spindle including the steps of grinding a predetermined number of workpieces to establish a first predetermined depth of super-abrasive wheel wear; producing a first fine truing compensation of a grinding wheel wear by controlling the position of the super-abrasive wheel with respect to the workpiece to maintain an apparent wheel wear depth within the range of desired workpiece tolerance; producing a second compensation of a grinding wheel conditioner by contacting the wear surface of the super-abrasive wheel with a non-metallic reconditioning tool surface while the wheel remains on the drive spindle and advancing it into and away from the tool surface a distance equal to a second predetermined depth an order of magnitude greater than the first predetermined depth each time that the wheel is reconditioned so as to condition said super-abrasive wheel so that individual particles of a super-abrasive constituent of the wheel will extend beyond a bonding material constituent of the wheel to re-establish grinding wheel efficiency following the fine truing compensation.

3. A dual compensation method for conditioning the wear surface of a super-abrasive grinding wheel mounted on a drive spindle comprising the steps of locating a workpiece support and a reconditioner tool support at fixed locations on a machine base and locating a super-abrasive grinding wheel and drive spindle on a movable platform; driving the platform by drive means under the control of a programmable controller; programming the controller to move the wheel while on the drive spindle into engagement with a consumable non-metallic reconditioning tool surface on the tool support only following a predetermined number of grinding sequences in which the wheel grinds a predetermined number of workpieces on the fixed workpiece support so as to produce a corresponding first predetermined depth of wear of the grinding surface on the wheel; programming the controller to produce a first fine truing compensation of the super-abrasive wheel by advancing the wheel with respect to the predetermined number of workpieces in addition to normal grinding wheel feed movement and in accordance with a predetermined schedule to maintain the apparent wear of the wear surface of the grinding wheel within desired workpiece tolerance ranges; and further programming the controller to produce a second compensation of the super-abrasive wheel during each reconditioning step by advancing and retracting the wheel into the surface of the consumable reconditioning tool a predetermined depth an order of magnitude greater than the first predetermined depth of wear so as to re-establish grinding wheel efficiency following the fine truing compensation.

* * * * *